US005603261A

United States Patent [19]

Buenz

[11] Patent Number: 5,603,261

[45] Date of Patent: Feb. 18, 1997

[54] WATER DISTRIBUTION SYSTEM IN AN INK FLOW TEMPERATURE CONTROL SYSTEM OF A PRINTING PRESS ARRANGEMENT

[75] Inventor: Robert J. Buenz, Winfield, Ill.

[73] Assignee: Tri Service, Inc., Melrose Park, Ill.

[21] Appl. No.: 613,164

[22] Filed: Mar. 8, 1996

[51] Int. Cl.[6] ..... B41F 5/00

[52] U.S. Cl. ..... 101/216; 101/141; 101/153; 101/174; 101/349; 101/487; 34/62

[58] Field of Search ..... 101/141, 147, 101/148, 153, 174, 216, 219, 349, 350, 425, 487; 34/62

[56] References Cited

U.S. PATENT DOCUMENTS

| | | | |
|---|---|---|---|
| 2,260,364 | 10/1941 | Case | 101/219 |
| 2,971,460 | 2/1961 | Shindle | 101/487 |
| 3,741,115 | 6/1973 | Keller | 101/148 |
| 4,879,951 | 11/1989 | Yoshida et al. | 101/366 |
| 5,130,730 | 4/1992 | Sarda | 101/425 |
| 5,189,960 | 3/1993 | Valentini et al. | 101/216 |
| 5,375,518 | 12/1994 | Kurz | 101/216 |
| 5,443,007 | 8/1995 | Buenz . | |
| 5,465,661 | 11/1995 | White | 101/487 |

*Primary Examiner*—Eugene H. Eickholt
*Attorney, Agent, or Firm*—John R. Hoffman

[57] ABSTRACT

A water distribution system is disclosed in an ink flow temperature control system of a plurality of printing presses such as multi-color offset perfecting and nonperfecting web and sheet fed presses. The system includes a plurality of printing presses each having at least one printing head whereat water is used to control the temperature of ink distributed through the head. A multiple zone control unit controls the temperature of water distributed to the printing heads of the plurality of printing presses. An enlarged rigid conduit extends between the multiple zone control unit and each printing press. A plurality of flexible non-metallic distribution hoses are located within the enlarged rigid conduit for distributing water between the multiple zone control unit and the printing heads of the plurality of printing presses.

6 Claims, 3 Drawing Sheets

WATER DISTRIBUTION SYSTEM IN AN INK FLOW TEMPERATURE CONTROL SYSTEM OF A PRINTING PRESS ARRANGEMENT

FIELD OF THE INVENTION

This invention generally relates to the art of printing machines and, particularly, to a system for distributing temperature controlled water or other liquid medium within an ink flow temperature control system for one or more printing presses having one or more printing heads.

BACKGROUND OF THE INVENTION

Printing machines normally include a printing couple or head which has a number of cylinders and/or rollers such as impression cylinders, master or plate cylinders, blanket cylinders, ductor rollers, transfer rollers, oscillating rollers, form rollers, and the like. For instance, an ink fountain is disposed generally at the rear of the machine for feeding ink to the various rollers of the printing couple which transfers images to copy sheets. In such printing machines as multi-color offset perfecting and nonperfecting web and sheet fed presses, a moisture fountain also is disposed adjacent the printing couple for feeding moisture to the printing couple. A number of rollers which generally can be termed "distribution" rollers are provided between the ink fountain and/or moisture fountain for distributing ink and/or moisture to the printing couple of the machine.

One of the problems with ink feeding systems in machines of the character described above is the inability to effectively compensate for varying environmental conditions, such as varying temperature and/or humidity. It has been found that moisture content or "presence" in the immediate environment of a printing or duplicating machine may be for the biggest problem area in maintaining quality printing. For instance, too much moisture in an inking system can "flood" the ink and cause emulsification. Even a 0.5–1.0 percent change in humidity can have a significant change in the ink flow characteristics of the machine. Consequently, an operator is constantly adjusting the ink fountain and/or moisture fountain of the machine in varying environmental conditions, because controlling the environmental humidity is very difficult if not impossible in a particular location. Yet, moisture control cannot be divorced from temperature control within the printing unit.

The moisture problem, above, in conjunction with the need for ink/water balance in conventional offset lithography has traditionally been the source of a multitude of problems for the offset printer. Variations in ink/water balance can cause emulsification of ink, as stated above, and can also lead to inconsistency in color, longer drying times, streaking problems as well as scumming and plugging of halftones. These variables include such things as water hardness, PH, conductivity, alcohol content, water take-up of ink and absorption of substrates.

Because of the various problems identified above, there is a definite contemporaneous trend to "waterless" printing processes and/or temperature control systems for the individual printing units in the printing process. By eliminating the need for ink/water balance, the waterless system changes the printing process from a chemical/physical process to a purely physical one, eliminating a large percentage of process variables as described above. The waterless system offers a shorter learning curve for press operators and greater ease of operation. Because there is no need to achieve ink/water balance at the start of a press run, a waterless press can roll up to color almost immediately. The system will normally achieve color in less than twenty impressions, thus giving the press operator nearly instant color communication. Response times to color changes are dramatically improved over conventional lithography. Controlling the water temperature of the individual printing units gives greater control of the printing process.

A control system to maintain the proper temperature is required for a waterless printing process. The control system normally includes a water circulation system through one or more points of the printing unit such as the plate cylinder, the vibrator roller(s) or the ink "ball" roller of the printing unit. A popular temperature control system circulates the water through one or more of the ink distribution rollers of the machine, such as an oscillating or vibrator roller. The system also includes water heater and chiller units, pumps, valving and appropriate conduits or piping. A temperature monitoring system is incorporated in the printing unit, such as at the plate cylinder surface, and a feedback system is provided to control the plate cylinder surface temperature by adjusting either water temperature or water flow to the vibrator roller(s). The bulk of the water circulation system, such as the water heater and chiller units, pumps, valving and the like normally are housed remote from the printing machine itself.

Because of the remoteness of the control unit, a water distribution system is required between the remote control unit and the ink distribution rollers of the machine through which the water is circulated. Heretofore, the water distribution systems of the prior art have included hard metal conduits or pipes, such as of copper material or the like. Such hard metal piping is not very cost effective, particularly in installation costs, which include many straight pipe pieces, elbows, junctures and the like. Cosmetically, such hard metal piping is not aesthetically pleasing at all. Other problems include potential water leakage because of the number of pipe pieces and fittings required between the remote control unit and the printing machine. Such hard metal piping also has a tendency to "sweat" due to differential temperatures between the water within the piping and the temperature of the surrounding environment. All of these problems are magnified in a multi zone control system wherein a plurality of printing machines or a plurality of printing units within a large press, for instance, are controlled from a single control unit which is considerably remote from the machines themselves.

The present invention is directed to solving this myriad of problems by providing a very simple, cost effective and substantially maintenance free water distribution system between a remote control unit of an ink flow temperature control system and one or more printing presses controlled by the system.

SUMMARY OF THE INVENTION

An object, therefore, of the invention is to provide a new and improved water distribution system in an ink flow temperature control system for printing presses such as multi-color offset perfecting and nonperfecting web and sheet fed presses.

In the exemplary embodiment of the invention, the water distribution system is shown for use with a plurality of printing presses each having at least one printing head whereat water is used to control the temperature of ink distributed through the head. A multiple zone control unit is provided for controlling the temperature of water distributed to the printing heads of the plurality of printing presses. A rigid conduit means are provided between the multiple zone control unit and each printing press. A plurality of flexible non-metallic distribution hoses are provided within the conduit means for distributing water between the multiple zone control unit and the printing heads of the plurality of printing presses.

Preferably, the rigid conduit means are fabricated of metallic material. The flexible non-metallic distribution hoses preferably are fabricated of vinyl, rubber and similar material.

As disclosed herein, the rigid conduit means include a singular conduit leading from the multiple zone control unit to a juncture. A plurality of conduits lead from the juncture to the plurality of printing presses. It should be understood that the water distribution system of the invention is equally applicable for use with a single printing press having a plurality of printing heads.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
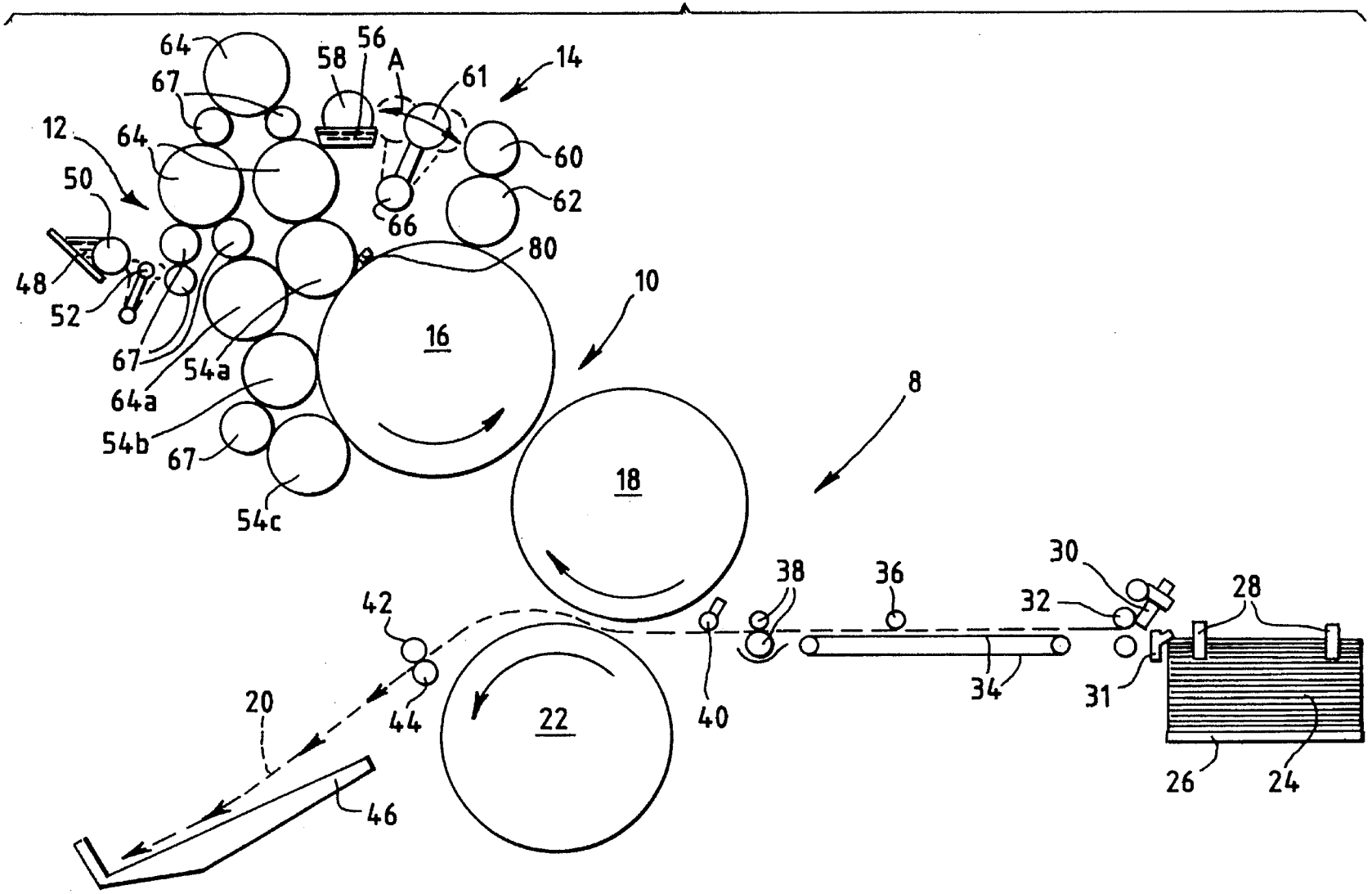
FIG. 1 is a schematic illustration of the major components of a single printing head in a printing machine in which the invention is applicable.

Referring to the drawings in greater detail, and first to FIG. 1, the major components of a printing press or machine, generally designated 8, are show schematically in generally applicable functional positions. The machine includes at least one printing unit or head, generally designated 10, which includes the conventional impression cylinders, blanket cylinders and master or plate cylinders. Usually, each printing unit or head includes one impression cylinder, one blanket cylinder and one master or plate cylinder.

More particularly, machine 8 is an offset lithographic duplicating machine which includes a printing head having an ink system, generally designated 12, and a moisture system, generally designated 14, for feeding ink and moisture, respectively, to a master or plate cylinder 16 to which a master or plate is clamped. An image from the master is transferred to a blanket cylinder 18, through surface transfer. The blanket cylinder transfers the image to a copy sheet which follows a paper path through the machine as indicated by dotted-arrow line 20 which passes between blanket cylinder 18 and an impression cylinder 22.

Generally, paper sheets are stacked, as at 24, in a paper elevator 26. Air blowers 28, vacuum feet 30, paper corner separator 31 and pull-out wheels 32 feed the sheets seriatim to a sheet transport conveyor 34 above which are mounted skid wheels 36. From conveyor 34, the sheets are fed seriatim by feed rollers 38 beneath a paper guide assembly 40 and between blanket cylinder 18 and impression cylinder 22, as described above. After images are transferred to the copy sheets, a paper ejector wheel 42 and a paper ejector roller 44 feed the sheets to a discharge station, generally designated 46.

Ink system 12 will be described generally and briefly, and includes an ink fountain 48 having a fountain roller 50. A ductor roller 52 feeds the ink from fountain roller 50 to a number of transfer rollers, regulator rollers, oscillating rollers and, ultimately, to three ink form rollers 54*a*, 54*b* and 54*c* which transfer the ink to a master on master cylinder 16 by surface contact.

Moisture system 14 includes a moisture fountain trough 56 and a fountain roller 58. Moisture is transferred from fountain roller 58 to a distribution roller 60 by a ductor roller 61 which reciprocates back and forth in the direction of double-headed arrow "A", about pivot 66, between fountain roller 58 and distribution roller 60. The construction and operation of the ductor roller is well known in the art. Moisture then is transferred, through continuous surface contact from distribution roller 60 to a form roller 62 which, in turn, transfers the moisture to the master on master cylinder 16, again through surface contact.

As stated above, ink system 12 includes a number of transfer rollers, regulator rollers, oscillating rollers and ink form rollers, including rollers 54*a*–54*c*. All of these rollers commonly are called "distribution" rollers for distributing ink from fountain 48 to printing unit 10, particularly to the master on master cylinder 16. Included in the ink train of distribution rollers are a plurality of oscillating rollers 64 and a plurality of transfer rollers 67. For purposes to be described hereinafter, one of the oscillating rollers is identified by the reference numeral 64*a*. A temperature control system provides one of the distribution rollers, such as oscillating roller 64*a*, as a substantially hollow roller or circulating water in a heat exchange relationship therethrough.

Figure 2:
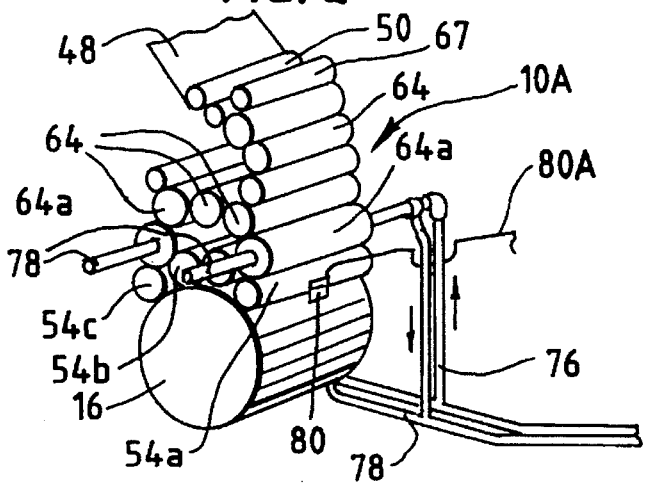
FIG. 2 is a schematic illustration of the major components of a waterless printing unit.

FIG. 2 shows a printing unit, generally designated 10A, which may or may not have the same roller configuration as printing unit 10 in FIG. 1. Therefore, like numerals are applied in FIG. 2 corresponding to the same type of rollers described above in relation to FIG. 1. Printing unit 10A is of a type that would be used in a waterless printing machine or process and, consequently, it can be seen that the moisture system 14 of printing unit 10 in FIG. 1 has been eliminated in printing unit 10A in FIG. 2. Printing couple 10A includes two oscillating or vibrator rollers 64*a* which are substantially hollow for circulating water in a heat exchange relationship therethrough.

Still referring to FIG. 2, a known temperature control system includes water circulation pipes 76 which lead from the control system to rollers 64*a* (or roller 64*a* in FIG. 1) and water circulation pipes 78 which lead from the rollers back to the control system. The temperature control system includes a water heating means and a water chilling means, along with pumps and appropriate valves and other piping as is known in the waterless printing art. All of the major components of the temperature control system, including the heaters, pumps, etc. are located remote from the printing press or machine which includes printing unit or head 10 or 10A.

As also is known in the art, the ink flow temperature control system includes a temperature sensor 80 (FIGS. 1 and 2) for detecting the ink flow temperature through the printing couple or head and for generating a signal, through electrical line 80*a*, corresponding to a detected ink flow temperature. The ink flow temperature control system includes means responsive to the signal from temperature sensor 80 to regulate the temperature of the water circulating through oscillating rollers 64*a* in accordance with the detected ink flow temperature.

Printing units or heads 10 (FIG. 1) and 10A (FIG. 2) are shown as arrangements for printing on only one side of the sheets of paper. However, it should be understood that the invention is equally applicable for use with a variety of other printing units or heads, including those designed to print on both sides of the sheets of paper (commonly called "perfecting").

Figure 3:
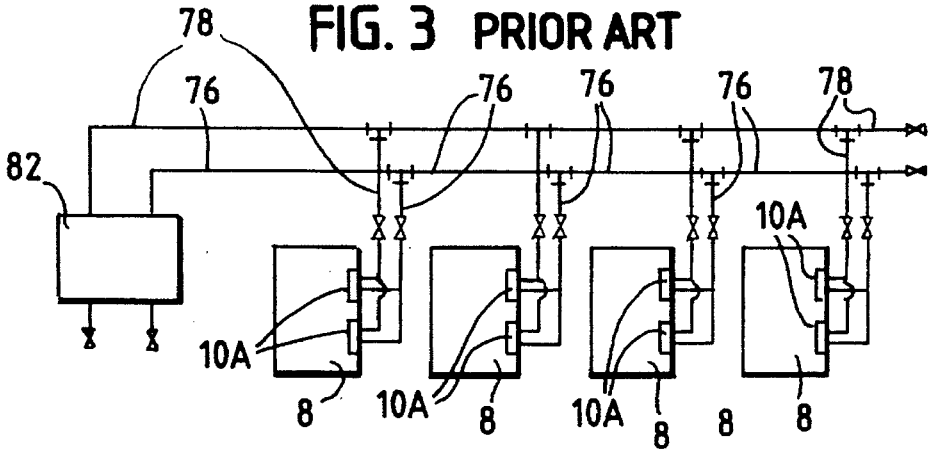
FIG. 3 PRIOR ART
FIG. 3 is a schematic illustration of an arrangement of four printing presses in conjunction with a single zone control unit of the prior art.

FIG. 3 shows a schematic illustration wherein a single zone temperature control unit 82 feeds regulated temperature water through circulation pipes 76 to the printing units or heads of a plurality of printing presses or machines 8, with each machine including a pair of printing units or heads schematically at 10A. Water is returned from the printing units or heads through water circulating pipes 78 to the single zone control unit 82. This is a standard system wherein the temperature of the water is regulated in a general fashion, and it can be seen that the network of supply pipes 76 and return pipes 78 are relatively modest. Conventionally, these water circulation pipes are fabricated of hard metal material, such as of copper, and the number of pipe sections and fittings are relatively modest. Still, the metal piping tends to "sweat" due to temperature differentials inside and outside the piping.

Figure 4:
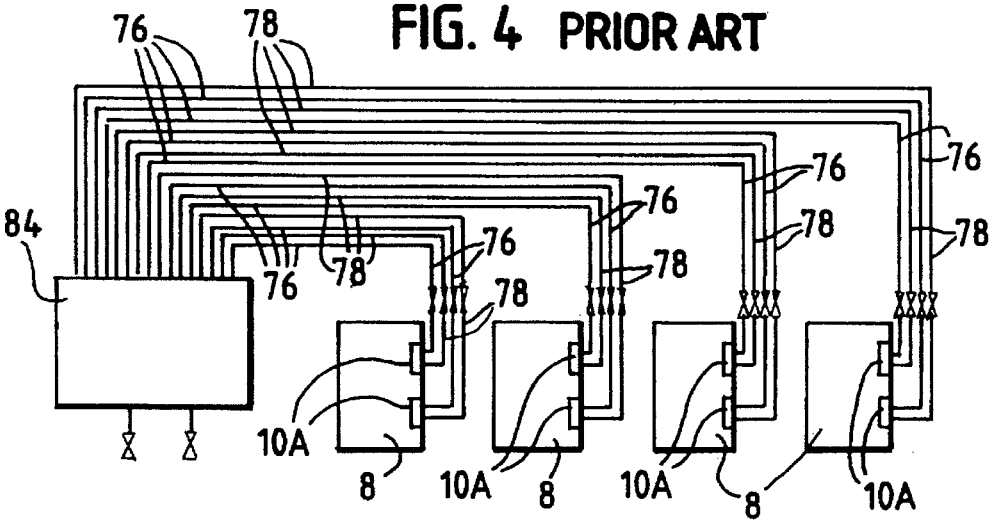
FIG. 4 PRIOR ART
FIG. 4 is a view similar to that of FIG. 3, but illustrating a multiple zone control unit and its extensive piping according to the prior art.

FIG. 4 shows a schematic illustration of a multiple zone control unit 84 which regulates the temperature and supply of water to the four printing presses or machines 8, but the printing units or heads of the presses include temperature sensing means such as that described above at 80 in FIGS. 1 and 2. In other words, each of the two printing heads 10A of each printing press 8 includes its separate supply and return water distribution pipes as indicated at 76 and 78 in FIG. 4. Because of the separate sensing of the ink flow temperature at each printing head of each printing press, along with the independent piping required, it can readily be seen that the piping network in FIG. 4 is quite extensive. Using rigid metal pipes and fittings according to the prior art in such multiple zone control systems has many problems or disadvantages as set forth in the "Background", above. The invention is directed to solving these problems.

More particularly, FIG. 5 again shows a multiple zone control unit 86 for controlling the temperature of water distributed to the printing heads of four printing presses or machines shown in phantom at 8. Each machine includes two printing units or heads as described above in relation to FIG. 2. Therefore, each printing head includes two oscillating rollers 64*a* (FIG. 2) each having a water supply conduit 76 and a water return conduit 78. In other words, there would be two supply conduits 76 and two return conduits 78 for the two oscillating rollers at each printing head as shown in FIG. 5.

The invention contemplates a water distribution system, generally designated 90 (FIG. 5) which generally includes enlarged rigid conduit means housing a plurality of flexible non-metallic distribution hoses leading from multiple zone control unit 86 to a plurality of distribution manifolds 92 at each printing press 8. The supply conduits 76 and the return conduits 78 at the printing heads of the machines are connected to the distribution manifolds 92.

More particularly, the enlarged rigid conduit means includes a singular enlarged conduit 94 leading away from multiple zone control unit 86 to an enlarged manifold conduit 96 which is in communication with a plurality (four) of branch enlarged conduits 98 leading to the four printing presses 8. Singular conduit 94, manifold conduit 96 and branch conduits 98 all are generally hollow, are in mutual communication with each other and are fabricated of metal material such as sheet metal.

Figure 5:
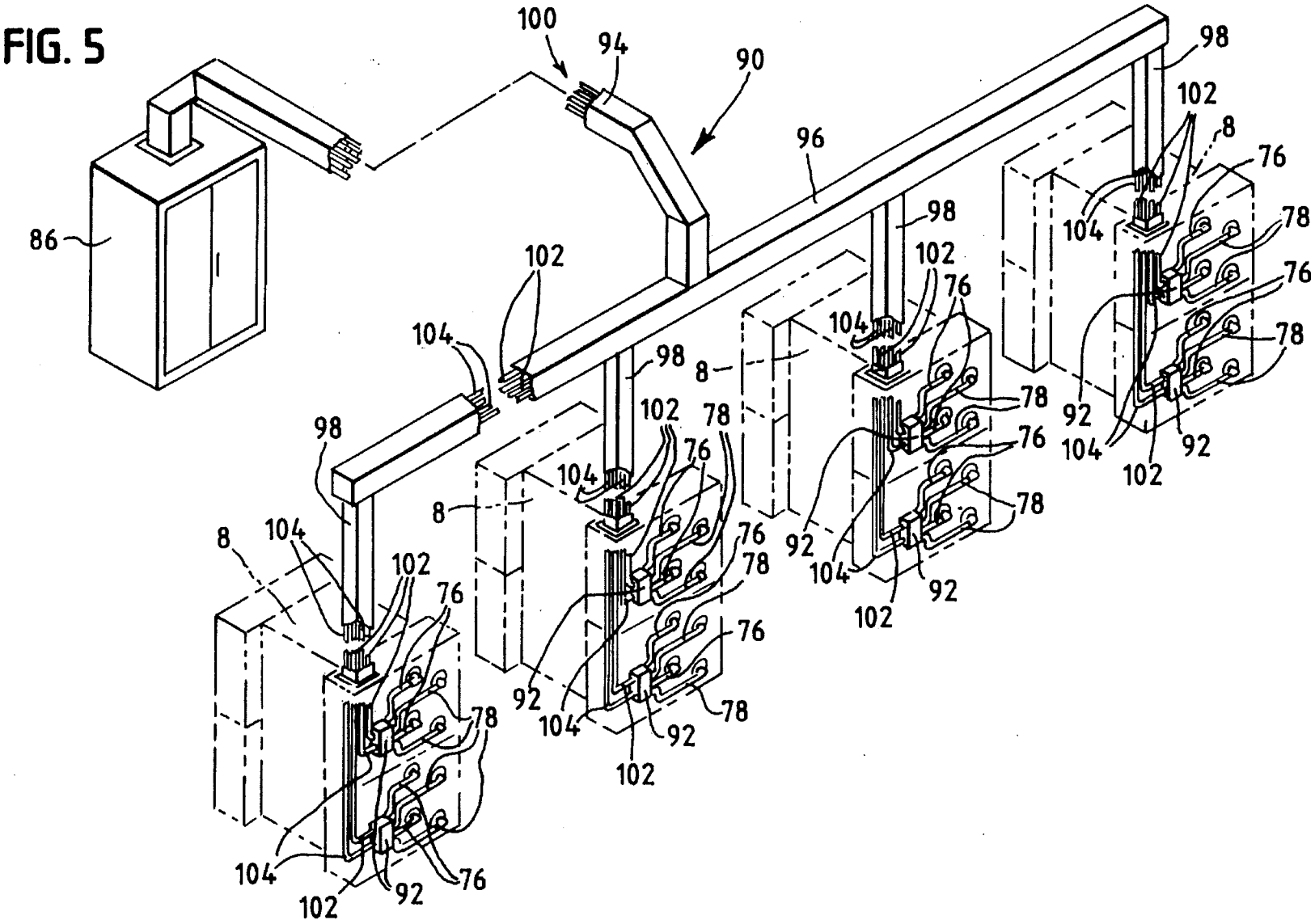
FIG. 5 is a somewhat schematic perspective view of a water distribution system between a multiple zone control unit and a plurality of printing presses, according to the invention.

A plurality of flexible non-metallic distribution hoses, such as at 100 in FIG. 5, are located within the enlarged rigid conduit means 94, 96 and 98 for distributing water between multiple zone control unit 86 and the printing heads 10A (FIG. 2) of the printing presses or units 8.

In the arrangement of FIG. 5, sixteen flexible non-metallic distribution hoses are located within singular rigid conduit 94, as at point 100. Eight flexible non-metallic distribution hoses would lead from the singular rigid conduit 94 in opposite directions away from conduit 94 within the manifold conduit 96. Four flexible non-metallic distribution hoses then would be fed through each branch conduit 98 for connection to the two distribution manifolds 92 at each printing press 8. Of these four flexible non-metallic distribution hoses at each printing press, two of the hoses 102 would comprise supply hoses for feeding regulated temperature water to supply conduits 76 which lead to the pair of oscillating rollers at each printing head. The other two flexible distribution hoses 104 are coupled through distribution manifolds 92 to return conduits 78 from the oscillating rollers at the printing heads of each printing press.

Preferably, flexible non-metallic distribution hoses 102 and 104 are fabricated of vinyl, rubber or similar material and, therefore, do not "sweat"as with the hard metal piping of the prior art. The hoses are much more cost effective in installation than the prior art hard metal piping. All of the fittings, such as elbows, junctures, etc. of the prior art piping are eliminated by the flexible distribution hoses. The hoses practically preclude potential water leakage of the prior art since individual hoses can extend entirely from multiple zone control unit 86 all the way to the remote printing presses which, in fact, may be in totally remote locations or rooms of a building. Of course, comparing FIG. 5 with the myriad piping network of FIG. 4, the water distribution system of the invention is much more cosmetically acceptable and aesthetically pleasing than the piping network of the prior art.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A water distribution system in an ink flow temperature control system of a plurality of printing presses such as multi-color offset perfecting and nonperfecting web and sheet fed presses, comprising:

a plurality of printing presses each having at least one printing head whereat water is used to control the temperature of ink distributed through the head;

a multiple zone control unit for controlling the temperature of water distributed to the printing heads of the plurality of printing presses;

an enlarged rigid conduit means between the multiple zone control unit and each printing press; and a plurality of flexible non-metallic distribution hoses within said enlarged rigid conduit means for distributing water between the multiple zone control unit and the printing heads of the plurality of printing presses.

2. The water distribution system of claim 1 wherein said enlarged rigid conduit means are fabricated of metallic material.

3. The water distribution system of claim 1 wherein said flexible non-metallic distribution hoses are fabricated of vinyl, rubber and similar material.

4. The water distribution system of claim 1 wherein said enlarged rigid conduit means include a singular rigid conduit leading from the multiple zone control unit to a juncture, and a plurality of other conduits leading from the juncture to the plurality of printing presses.

5. A water distribution system in an ink flow temperature control system of a printing unit, comprising:

a printing unit having a plurality of printing heads whereat water is used to control the temperature of ink distributed through the heads;

a multiple zone control unit for controlling the temperature of water distributed to the printing heads of the printing unit;

an enlarged rigid conduit means between the multiple zone unit and the printing press, the enlarged rigid conduit means being fabricated of metallic material; and a plurality of flexible distribution hoses within said enlarged rigid conduit means for distributing water between the multiple zone control unit and the printing heads of the printing press, the hoses being fabricated of vinyl, rubber and similar material.

6. The water distribution system of claim 5 wherein said enlarged rigid conduit means include a singular rigid conduit leading from the multiple zone control unit to a juncture, and a plurality of other conduits leading from the juncture to the plurality of printing heads.

* * * * *